US008459270B2

(12) United States Patent
Coven et al.

(10) Patent No.: US 8,459,270 B2
(45) Date of Patent: Jun. 11, 2013

(54) METHOD AND APPARATUS FOR PROCESSING CIGARETTE BUTTS

(76) Inventors: Malcolm Coven, Toronto (CA); Gregory Matthew Crossley, Toronto (CA); Kevin Mako, Buckhorn (CA)

( * ) Notice: Subject to any disclaimer, the term of this patent is extended or adjusted under 35 U.S.C. 154(b) by 458 days.

(21) Appl. No.: 12/923,343

(22) Filed: Sep. 15, 2010

(65) Prior Publication Data

US 2012/0061269 A1 Mar. 15, 2012

(51) Int. Cl.
*A24F 15/00* (2006.01)

(52) U.S. Cl.
USPC ..... 131/250; 131/242; 131/244; 131/231; 131/248; 131/253; 206/246; 206/242

(58) Field of Classification Search
USPC .. 131/242, 231, 233, 248, 253, 250; 206/246, 206/242; 411/338
See application file for complete search history.

(56) References Cited

U.S. PATENT DOCUMENTS

| | | | | | |
|---|---|---|---|---|---|
| 1,459,077 | A | * | 6/1923 | Winans | 131/233 |
| 1,846,252 | A | * | 2/1932 | Ford | 131/237 |
| 2,690,184 | A | * | 9/1954 | Campbell | 131/237 |
| 3,601,132 | A | * | 8/1971 | Etheridge | 131/256 |
| 4,897,033 | A | * | 1/1990 | Yang | 431/253 |

* cited by examiner

*Primary Examiner* — Richard Crispino
*Assistant Examiner* — Dionne Walls Mayes
(74) *Attorney, Agent, or Firm* — Bereskin & Parr LLP/S.E.N.C.R.L./s.r.l.

(57) ABSTRACT

A device to process cigarette butts has top and bottoms sections, one pivotably mounted on the other for rocking movement between open and closed positions. The bottom section has two access holes which are opened and closed by the rocking movement. When the holes are open, a user can insert a butt into one access hole and then can rock the top section, thus cutting the butt into a filter tip, and tobacco and paper materials. The tobacco and paper materials fall through a passage from the one access hole to the ground but do not cause a litter problem since they quickly biodegrade. The filter tips can be inserted into the second access hole into a storage space for later treatment and disposal. The bottom section has a thinned rear portion which allows increased rocking amplitude while minimizing the device thickness.

9 Claims, 5 Drawing Sheets

METHOD AND APPARATUS FOR PROCESSING CIGARETTE BUTTS

FIELD

This invention relates to a method and apparatus for processing cigarette butts so as to reduce the amount of litter on streets and in parks and other public places.

INTRODUCTION

For decades cigarette butts have been a major nuisance since smokers tend to discard their cigarette butts in virtually all public locations. The problem has worsened since smoking indoors has been banned in many cities. This simply increases the number of cigarette butts which are discarded on streets and near building entrances. In some locations nearly half of all the litter consists of cigarettes butts. Some experts estimate that in 2009 more than one trillion cigarette butts were discarded in public places.

Cigarette butts normally have two components. The first component is tobacco wrapped in thin paper. This first component disintegrates quickly once it has been discarded and does not usually create a major littering problem.

The second component of a cigarette butt is a filter tip. Virtually all cigarettes have filter tips. The filter tips are made of cellulose which is resistant to biodegrading, so the filter tips therefore remain relatively intact for a long time on streets and in other locations where they are discarded. The discarded filter tips are extremely unsightly and may in some cases present health concerns.

For the above reasons, various attempts have been made in the past to prevent cigarette butts from being discarded in public areas. A number of patents have been issued for devices which collect or destroy cigarette butts. In many cases these devices include containers to collect and store the cigarette butts until they can be discarded in a more suitable location, or otherwise destroyed. However, none of these devices has been commercially successful, and most have been inconvenient to use.

SUMMARY

Therefore it is an object of this invention to provide a device for processing cigarette butts, and which device is more convenient to use and more effective than the solutions provided in the past.

In a preferred embodiment, the invention provides a device for processing cigarette butts, said butts being of the kind having a filter tip and having a tobacco and paper portion extending from the filter tip, said device comprising (a) a container having top and bottom sections, said top and bottom sections each having a sidewall, the sidewall of one of said sections being larger in perimeter than the sidewall of the other section so that one of said sections is nested within the other, (b) said top and bottom sections being held together in said nested position by a set of pivot hinges, said hinges being arranged to allow at least one of said top and bottom sections to pivot back and forth on the other, (c) the sidewall of one of said top and bottom sections including an end wall having a pair of openings therein, one of said openings being to accept said tobacco and paper portion, the other being to accept said filter tip, (d) the sidewall of the other of said top and bottom sections including a second end wall adjacent the first mentioned end wall and having a sharpened edge adjacent said openings, so that said sharpened edge can move past said opening to cut off said filter tip from said tobacco and paper portion, and (e) so that the user may then insert the cut-off filter tip through another of said openings to store such cut-off filter tip until the user is ready to discard it.

Further objects and advantages of the invention will appear from the following description, taken together with the accompanying drawings.

DRAWINGS

DESCRIPTION OF VARIOUS EMBODIMENTS

Figure 1:
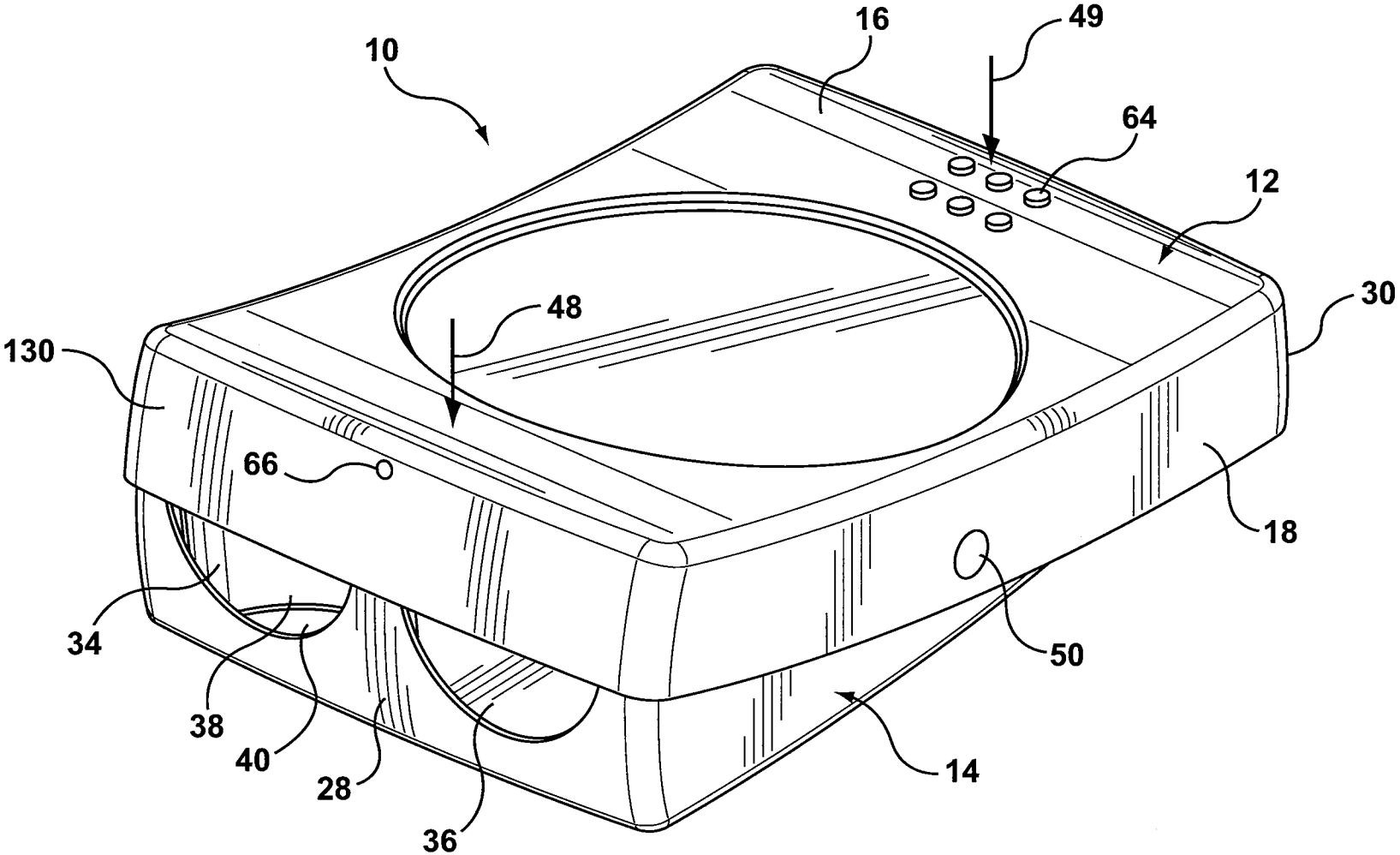
FIG. 1 is a perspective view of a container according to the invention, open and ready to receive a cigarette butt.
Figure 2:
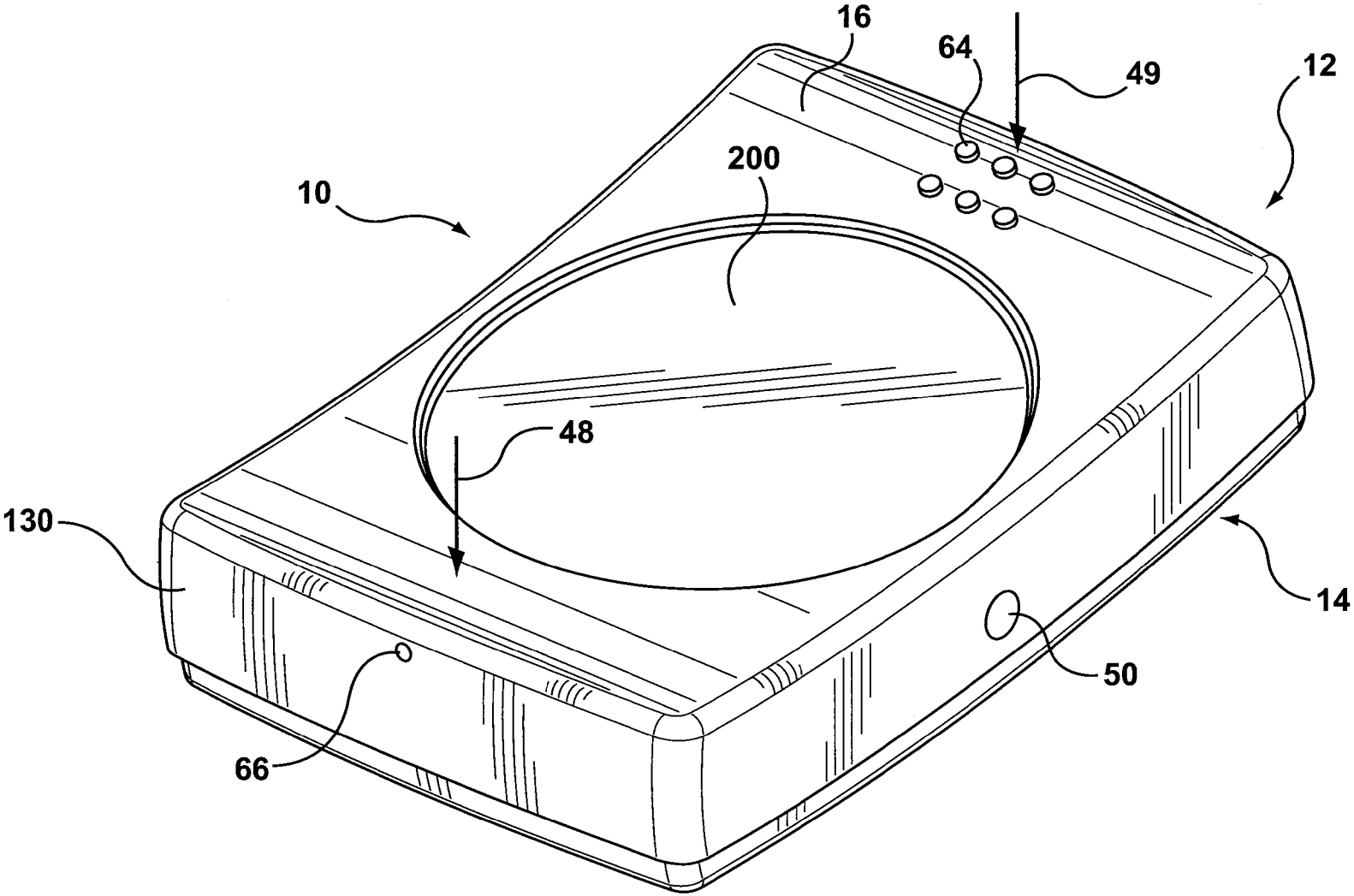
FIG. 2 is a perspective view of the FIG. 1 container in closed position.
Figure 3:
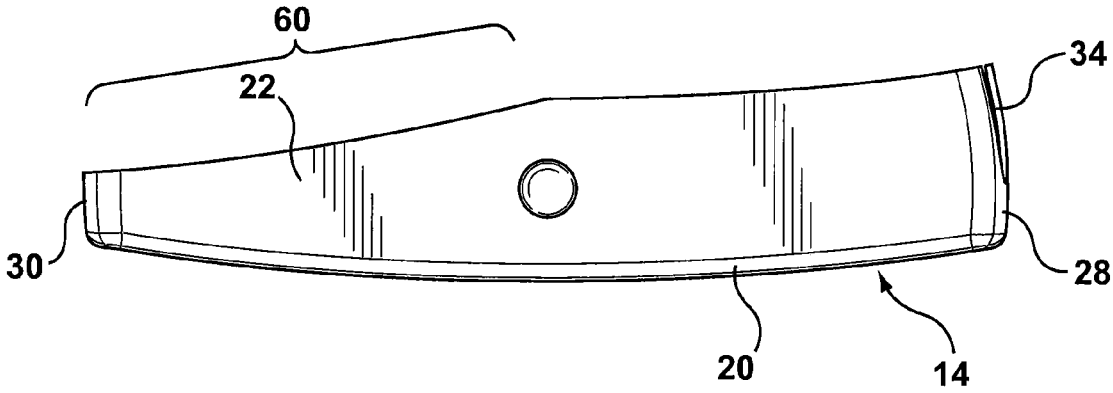
FIG. 3 is a side view of the bottom section of the FIG. 1 container.
Figure 4:
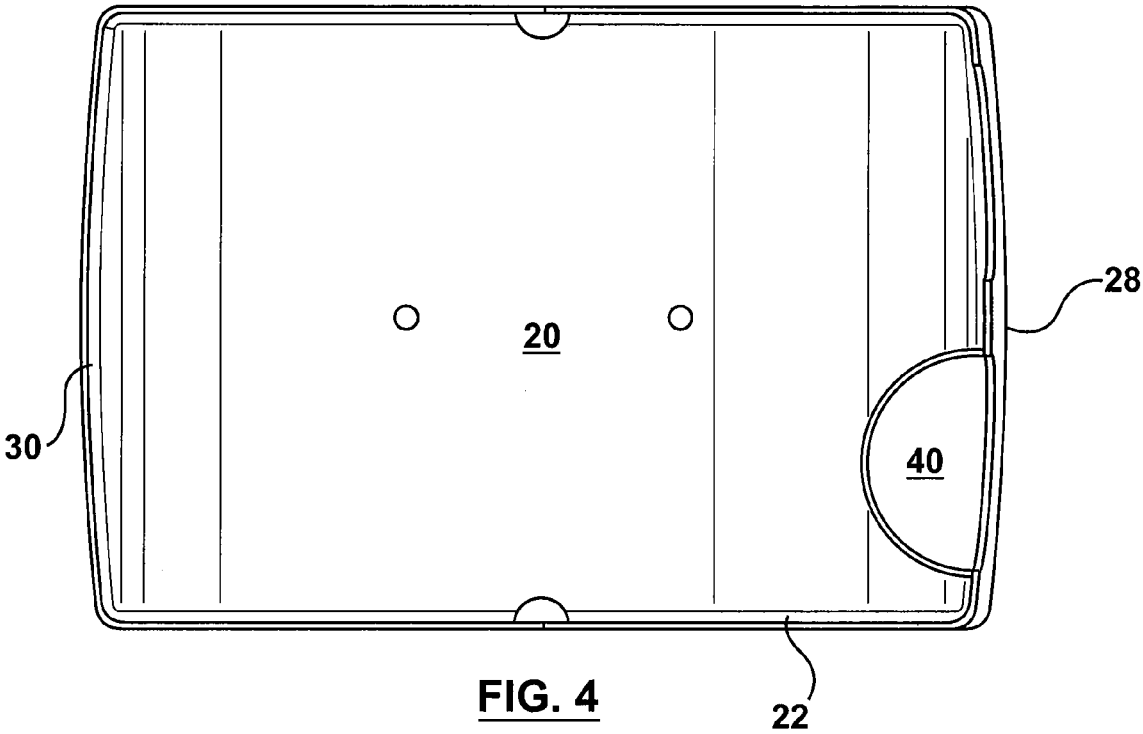
FIG. 4 is a plan view from above of the bottom section of the FIG. 1 container.
Figure 5:
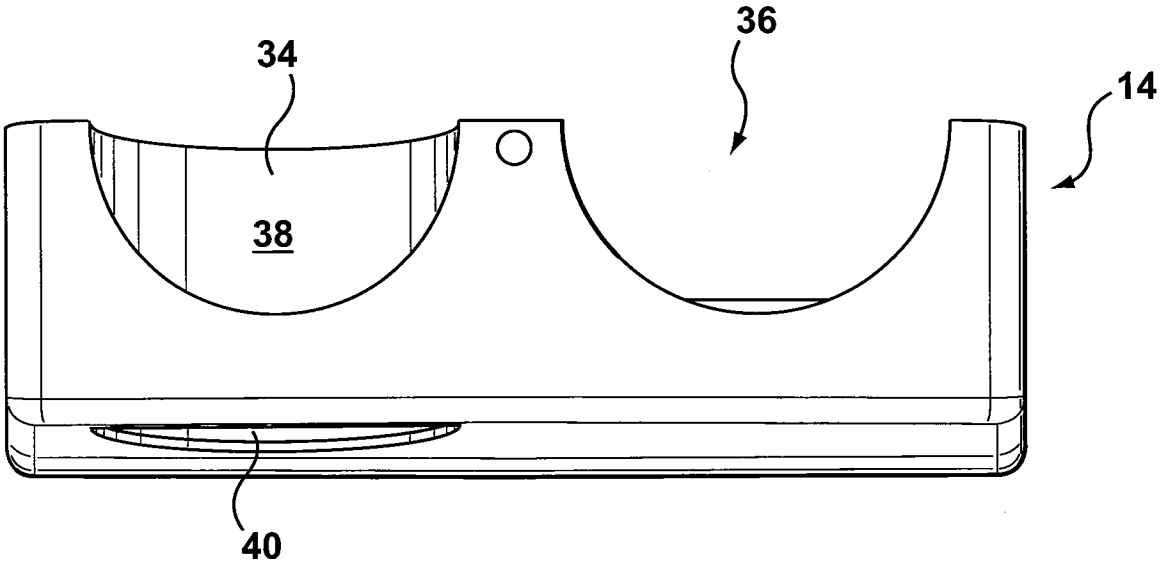
FIG. 5 is an end view of the bottom section of the FIG. 1 container.
Figure 6:
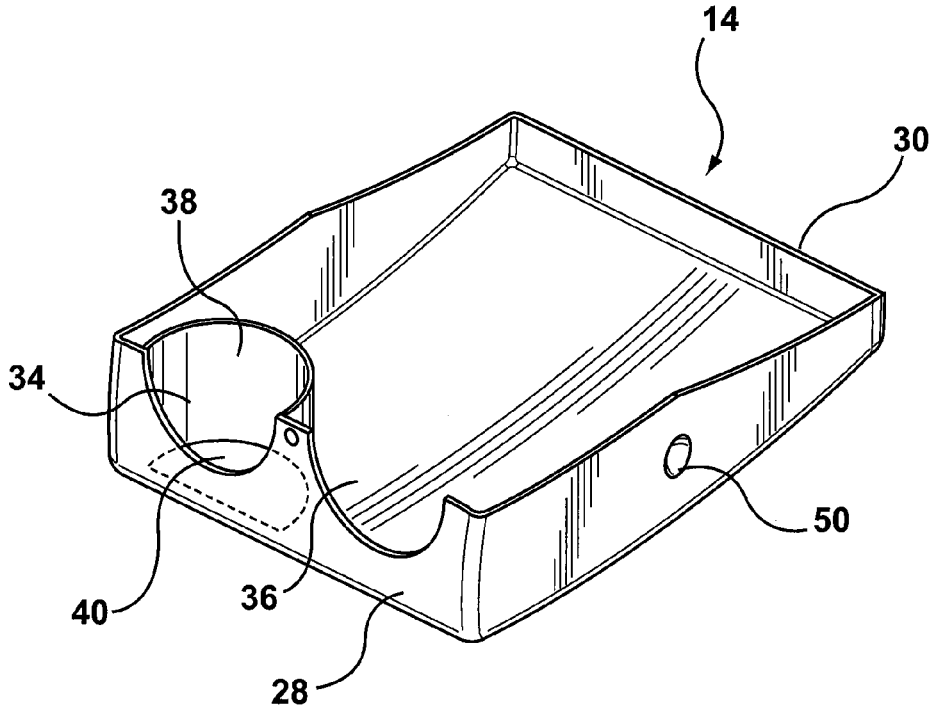
FIG. 6 is a perspective view of the bottom section of the FIG. 1 container and showing the interior thereof.
Figure 7:
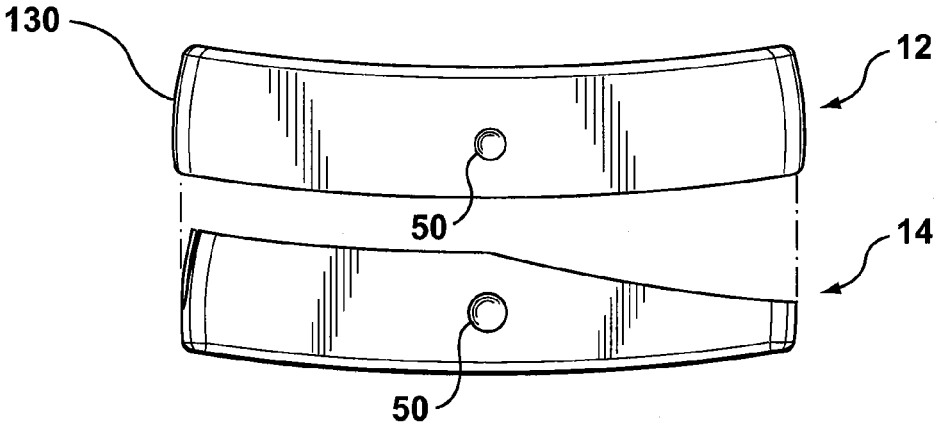
FIG. 7 is a side exploded view of the top and bottom sections of the FIG. 1 container, spaced apart and ready to be assembled.

Reference is first made to FIGS. 1-6 of the drawings, which show a container 10 used in a preferred embodiment of the invention. The container 10 is essentially a two-part container having a top section 12 and a bottom section 14. The top section 12 includes a top wall 16 (which forms a top for the container) and further includes a sidewall 18 which extends downwardly from the top wall and encircles the entire perimeter of the top wall. The top wall 16 may optionally contain a recessed portion 200 which can be used to display advertising, text, graphics or any other desired matter.

The bottom section 14 similarly contains a bottom wall 20 (see FIG. 3) (which forms a bottom for the container). A sidewall 22 extends upwardly from the bottom wall 20 and encircles the entire perimeter of the bottom wall. (The two sidewalls 18, 22, together form the side of the container 10.)

The top sidewall 18 is slightly longer and wider than the bottom sidewall 22, so that the bottom sidewall can "nest" within the space enclosed by the top sidewall 18, for a purpose to be described.

The bottom section 14 of the container includes front and rear end walls 28, 30 (which are part of the sidewalls). The front end wall 28 contains a pair of side-by-side openings 34, 36 in its upper edge. The opening 34 connects to a passageway 38 in the interior of the container 10. The passageway 38 may be formed entirely from the structure of the lower section 14, or it may be formed in two parts from the structures of the upper and lower sections 12, 14 (this latter version is not preferred). The passageway 38 leads to a discharge opening 40 in the bottom wall 20, so that a piece of material inserted through the opening 34 into the passageway 38 will exit through opening 40 and thus will be discarded.

The second opening 36 in the end wall 28 simply opens into the interior space of the container 10.

Figure 8:
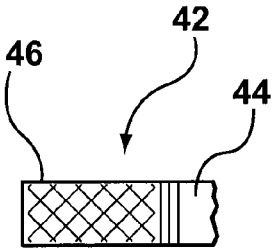
FIG. 8 is a side view showing a typical cigarette butt with which the invention is used.

The container 10 operates as follows. To begin, a cigarette butt 42 (FIG. 8) is inserted into the opening 34 and into the passageway 38 to the extent needed so that the entire tobacco and paper portion 44 of the cigarette butt is located within the passageway 38. The user holds the butt in this position by gripping the filter tip 46 of the butt with his fingers. The user then pushes the front of the container top wall 16 downwardly as indicated by arrow 48 (see FIG. 1). This produces a rocking motion of the top section 12 about a pair of disengagable pivot hinges 50. The hinges 50 are constituted by a pair of stub axles located at about the center (in a front to rear direction) of the sidewall 18. The axles 50 are axially aligned and project inwardly towards each other to allow the front and rear ends of the top section 12 to rock up and down on the bottom section 14 (much like a teeter-totter). Thus, the front end wall 130 of the top section 12 can be pivoted down to a closed position in which the front end wall 130 of the top section covers the openings 34, 36 (see FIG. 2). Alternatively the rear end of the top section 12 can be pivoted or rocked downwardly to an open position in which the lower edge of the front end wall 130 of the top section is located above the openings 34, 36. In this open position, the lower edge of the front end wall 130 is as noted raised sufficiently to expose the openings 34, 36.

Next, a cigarette butt is inserted into opening 34 (for which purpose the device must be in its opened position), and then the front end wall 130 of the top section 12 is pushed downwardly as indicated by arrow 48. The sharp lower edge of the front end wall 130 then moves downwardly to close the openings 34, 36 and at the same time cuts off the portion of the cigarette butt which projects outwardly from the opening 34. In effect the front end wall 130 of the top section acts as a guillotine to cut off the paper and tobacco portion of the butt from the filter tip 46. After these two parts of the butt have been cut apart, then the user while continuing to grip the filter tip 46, moves the filter tip to a location in front of the opening 36. The user then opens the opening 36 (by pushing on the rear of the container's top wall as shown by arrow 49 (FIG. 1)). The user then inserts the filter tip which he/she is holding through the opening 36 into the container's interior, where it is stored until the collected filter tips can be discarded in an environmentally friendly manner.

When the user wishes to open the container to discard the stored filter tips, the user pulls the top and bottom sections 12, 14 apart by separating the pivot hinges 50 in any desired manner. For example the hinges 50 may be formed from a pair of short cylindrical axles which are spot welded or secured in any other desired manner to the sidewall 18 of the top section and which may be press fitted into matching openings (not shown) in the sidewall 22 of the bottom section 14. The mating parts can be tapered and can have detents formed in them in known manner so that the hinges connect together sufficiently securely and yet are disconnectable without the need for undue force.

It is desirable to be able to open the openings 34, 36 wide enough to accept most or all standard size cigarette butts. For this purpose it must be possible to lift the front end wall 130 of the top section 12 (i.e. the "guillotine blade") high enough so that the openings 34, 36 will accept a large enough cigarette butt or a filter tip. To permit this without making the container 10 too thick, the rear part of the top section 12 is preferably made thinner than the front part, i.e. the rear part has a "cut away" portion 60 (see FIG. 3). Thus, when the user pushes down on the rear top surface of the top section 12, as indicated by arrow 49, then the rear of the top section 12 can move downwardly farther than would have been possible if the front and rear parts of the top section 12 had both been of the same thickness. It will be seen that the thinner rear of the bottom section 14 allows the user to raise the guillotine higher than would have been possible if the thinner rear portion 60 of the bottom section had not been a feature.

To guide the user as to where he/she should push, and also to assist the user, small dimples 64 or other rough textures can be applied to the location on the top wall at the rear of the top section where the user must push downwardly. In addition, in order to hold the container 10 in its closed position so that collected filter tips do not spill out of the closed container 10, small mating dimples 66 can be stamped in the front end walls of the upper and lower sections 12, 14. These dimples can be of shape and size so that they will hold the top and bottom sections in closed position by preventing rotation of the top and bottom sections relative to each other. A user can easily release the dimples 66 from their mated position simply by pushing on the top wall of the top section 12 at the rear end thereof, as shown by arrow 49.

If desired, various changes can be made in the container described. For example, if the described container 10 is used outdoors, there is no need to collect the tobacco and paper component of the cigarette butt, and there is usually no concern about this material being discarded on the ground. However, if the container is being used indoors or in certain other locations, it would be undesirable to permit the tobacco and paper to fall to the ground whenever a cigarette butt is cut. Therefore, if the container is to be used indoors, the container may further include an interior wall 70, dividing the interior of the container into two separate spaces 73, 74 (see FIG. 9).

Figure 9:
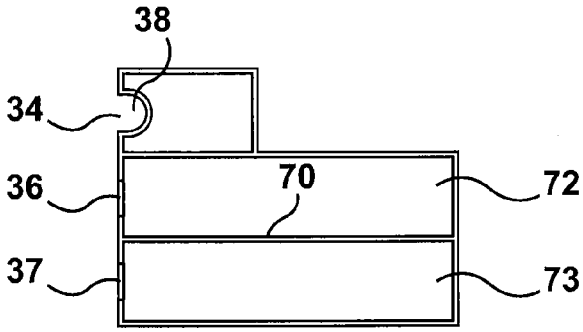
FIG. 9 is a top plan view of the bottom section of a modified container, illustrating another embodiment of the invention.

In the FIG. 9 version, the front end wall 130 of the top section now has three openings therein 34, 36, 37. One opening 34 leads to the passageway 38 as before, so if a butt is cut using opening 34, then any tobacco and paper products will be discarded onto the ground. However, if a butt is cut using opening 36, then any tobacco and paper products present will be directed into space 72 for retention until the user can discard them. Therefore the user now has a choice about whether or not to discard the tobacco and paper products onto the ground or to store them for later disposal. In all cases the filter tips are as before separately stored in space 73.

Any desired arrangement can be used to empty separately the two interior spaces 72, 73 of the container 10. For example, container 10 can have two separately operable lids, one lid for each storage space in the container.

While preferred embodiments of the invention have been described, it will be understood that appropriate changes can be made, and all such changes if within the scope of the attached claims are intended to be included as part of the invention.

The invention claimed is:

1. A device for processing cigarette butts, said butts being of the kind having a filter tip and having a tobacco and paper portion extending from the filter tip, said device comprising (a) A container having top and bottom sections, said top and bottom sections each having a sidewall, said sidewalls extending toward each other, the sidewall of one of said sections being larger in perimeter than the sidewall of the other section and said sidewalls being of shape such that one of said sections is nested within the other, (b) said top and bottom sections being held together in said nested position by a set of hinges, said hinges being arranged to allow at least one of said top and bottom sections to pivot back and forth on the other, (c) the sidewall of one of said top and bottom sections having a pair of openings therein, one of said openings being to accept said tobacco and paper portion, the other being to accept said filter tip, (d) the sidewall of the other of said top and bottom sections having a sharpened edge adjacent said openings, so that when one section is pivoted relative to the other section, said sharpened edge will move past said opening to cut off said filter tip from said tobacco and paper portion, (e) so that the user may then insert the cut-off filter tip through another of said openings to store such cut-off filter tip in said container until the user is ready to discard it.

2. A device according to claim 1 wherein said top section has a front part and a rear part, said rear part being thinner than said front part to allow said top section to pivot farther rearwardly than forwardly.

3. A device according to claim 2 wherein one of said openings connects with an interior space of said container and the other of said openings connects with a space outside the container.

4. A device according to claim 1 wherein one of said openings connects with a first interior space of said container and the other said opening connects with a second interior space in said container, said second interior space being separate from the first interior space, so that the user can store filter tips in one space and can separately store tobacco and paper in the second space.

5. A device according to claim 4 wherein said sidewall of said bottom section includes a third opening, said third opening connecting with an exterior space which is outside said container, so that the user can select one interior space for storing filter tips and can select either a second interior space separate from the first interior space for storing cigarette paper and tobacco or can discard cigarette paper and tobacco into said exterior space.

6. A device according to claim 5 wherein said exterior space is an outdoor space.

7. A device according to claim 1 wherein said top and bottom sections are removably held together, for pivoting movement of one said section on the other, by a pair of short axles extending between the respective sidewalls of the top and bottom sections, said axles being disconnectable from at least one of said top and bottom sections to allow a user to disconnect said top and bottom sections from each other for emptying the container.

8. A device according to claim 1, said device having a closed condition when said top section has been pivoted on said bottom section to a position in which said sidewall of said top section blocks said openings, and said device having an open condition when said sidewall of said top section has been pivoted to a position in which it leaves said openings unblocked sufficiently for said tobacco and paper portion to be inserted therethrough, at least one sidewall of each of said top and bottom sections including a detent portion, said detent portion of said top section being releasably engagable with the detent portion of said bottom section so that when said detent portions are engaged with each other, they hold the top and bottom sections releasably in a fixed position and unable to pivot relative to each other, the extent of engagement of the detent portions being such as to allow disengagement of said detent portions from each other when one of said top and bottom sections is pushed relative to the other with sufficient force, thereby allowing said pivoting and thus permitting a said sharpened edge of an opening to cut off said filter tip and allowing the user to open said openings after such cutting to insert said filter tip through one of said openings.

9. A device according to claim 8 wherein each sidewall includes side portions and end portions, said hinges being located in said side portions and said detent portions being located in at least one end portion of each sidewall.

* * * * *